United States Patent [19]

Bager

[11] 4,100,399

[45] Jul. 11, 1978

[54] PROGRAMMED CONTROL FOR EFFECT SPINNING AND TWISTING MACHINES

[75] Inventor: Reinhard Bager, Betzigau, Germany

[73] Assignee: Saurer-Allma GmbH, Kempten, Germany

[21] Appl. No.: 719,214

[22] Filed: Aug. 31, 1976

[30] Foreign Application Priority Data

Sep. 4, 1975 [DE] Fed. Rep. of Germany ..... 2539341

[51] Int. Cl.[2] ..... G07C 3/10

[52] U.S. Cl. ..... 235/92 CC; 57/91; 235/92 PE; 235/92 PD; 235/92 R

[58] Field of Search ..... 235/92 PD, 92 PE, 92 DN, 235/92 CA, 92 CC, 92 DE, 92 CT; 57/91

[56] References Cited

U.S. PATENT DOCUMENTS

| | | | |
|---|---|---|---|
| 3,449,899 | 6/1969 | Cureton et al. | 57/91 |
| 3,674,991 | 7/1972 | Isvetkov et al. | 235/92 PD |
| 3,961,500 | 6/1976 | Braley et al. | 235/92 PD |

*Primary Examiner*—Joseph M. Thesz

*Attorney, Agent, or Firm*—Blanchard, Flynn, Thiel, Boutell & Tanis

[57] ABSTRACT

A programmable electronic control system is provided to control the feed devices which supply different threads at different speeds in a spinning or twisting machine in order to produce yarn with special effects of color or shape at intervals along the yarn. The control system is supplied with clock pulses synchronous with the machine at intervals corresponding to a unit length of the basic thread feed. The length of a program module is determined by a settable pulse divider operating on the clock pulses and the resulting pulses are fed to a settable counter which determines the points in the module at which changes take place. Provision is made for repetition of program units a selected number of times and for interruption of the program at a random point.

17 Claims, 1 Drawing Figure

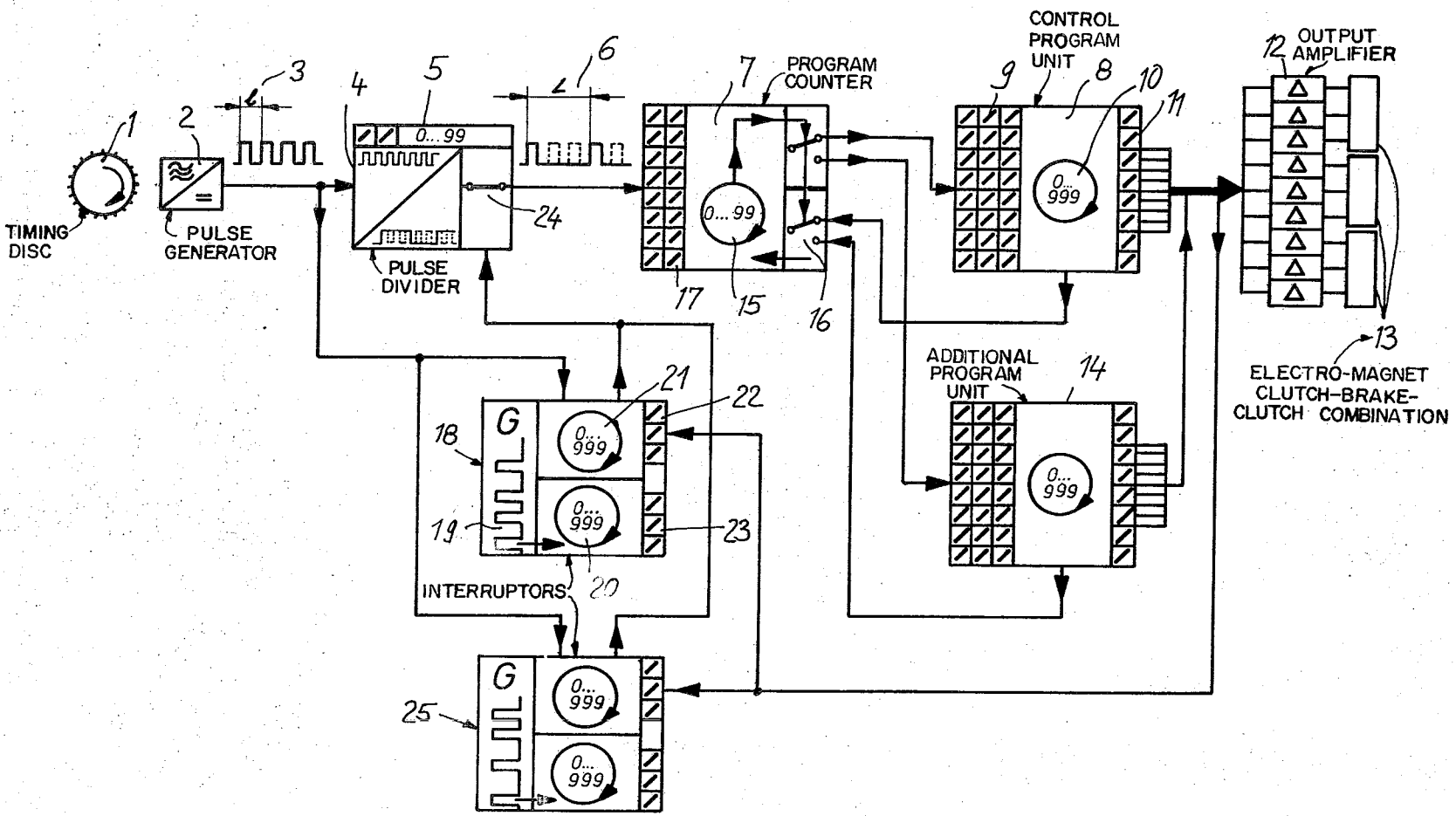
OUTPUT AMPLIFIER
ELECTRO-MAGNET CLUTCH-BRAKE-CLUTCH COMBINATION
CONTROL PROGRAM UNIT
ADDITIONAL PROGRAM UNIT
PROGRAM COUNTER
PULSE DIVIDER
PULSE GENERATOR
TIMING DISC
INTERRUPTORS
0...99
0...999
G

PROGRAMMED CONTROL FOR EFFECT SPINNING AND TWISTING MACHINES

FIELD OF THE INVENTION

The invention relates to a switching arrangement for programmed control of twisting and spinning machines which produce effect yarns and have at least two feed devices, of which at least one is controllable, a timing device synchronous with the machine and at least one settable counter controlled by the timing device.

BACKGROUND OF THE INVENTION

For the production of effect yarns with periodic or aperiodic effects spinning and twisting machines are used with at least two feed devices, of which at least one is controllable. For this the feed cylinder is switchable by means of electromagnetic couplings between two rotational speeds and a stationary condition. The control of the feed devices results as a rule from a program, which is inserted in the machine according to the operational principle in the form of a punched tape, a punched card, or a cam drum.

Punched tape and punched card control have the disadvantage of expensive program generation. If, that is to say, an effect program goes beyond the simple changeover function of two feed device speeds, a new program must as a rule be tested on the machine. It is then very often necessary to correct the program, which with punched tape or punched cards usually leads to the production of a new program carrier.

With the use of cam drums more or less narrow limits are set on the inventiveness of the effect twist, because the program carrier would become too elaborate in peripheral surfaces. Moreover regard must always be had, with such a revolving program, to the fact that the program record is spread over a predetermined peripheral length of the program carrier.

Since in many cases an exact modular repetition of the effect program is not desired on account of possible patterning in the material during the further processing, the expiring program is interrupted. This means that the predetermined switch point of the feed device is shifted within a module. To carry out this interruption two possibilities are already known, namely first the mechanical, the so-called storage swinging and for the other the electrical by way of a timing relay. The mechanical method has it is true the advantage of running in synchronism with the machine, it effects however an exact repetition of the interruption, so that in the end over a greater length an identical module arises.

Interruptions by means of a timing relay have the disadvantage that the interruption level is always of the same magnitude whereas because of its being asynchronous with the machine it is difficult to produce an effect program with the same interruptions on various machines. Mechanical or electromechanical controls moreover are subject to wear and tear on account of their multiplicity of moving parts. With increasing wear and tear however the departure of the effect pattern from the programmed effect pattern also increases.

The problem of the invention is therefore to produce a switching arrangement for programmed control of such effect twisting and spinning machines, which significantly facilitates alteration of the program and makes possible a greater range of variation in the formation of the program.

According to the invention this is achieved in that the pulse period of each timing pulse delivered by the timing device corresponds to a unit length of thread feed and that this unit magnitude is used for the programming of all switching instructions and functions.

Through the fully electronic effect program control in accordance with the invention the production of varieties of effect is set practically no limits any more while the program is easily initiated, suspended and controlled, and any wear and tear with the result of departures from the program is excluded.

Further characteristics of the switching arrangement in accordance with the invention as well as its advantages will appear from the following description.

The schematic layout of the whole control is apparent from the FIGURE.

The timing disc 1, which runs in synchronism with the feed device for the basic effect thread, actuates the pulse generator 2 for the delivery of timing pulses 3, the timing disc 1 being so constructed that the separation of the timing pulses (pulse period L) corresponds exactly with a unit length, preferably 1 mm, of thread delivery. The timing pulses 3 are counted out in a pulse divider 4. By corresponding selection of a division number between 0 and 99 at the preselector 5 the program is divided in each case by whole multiples, that is to say that for a set-in number of, e.g., 30 only every 30th timing pulse is transmitted by the pulse divider as a count pulse 6 (pulse period L).

By way of a repetition control unit, especially a program counter 7, which will be dealt with in more detail later, the count pulses reach the control program unit 8. The control program unit consists of the switch instruction selector 9, a counter 10 programmable between 0 and 999 switching instructions and an adjustable switching instruction co-ordinator 11, by way of which the switch pulse is transmitted to the output amplifier 12. The end stages 13, consisting of electromagnetic clutch-brake-clutch combinations are switched through semiconductor devices.

In the present example an effect twisting machine with three feed devices is to be controlled, in which each feed device is equipped with a clutch-brake-clutch combination. A rapid change of rotational speed of a feed device is only possible through change-over switching of two clutches which are driven at different gear ratios. Therefore nine output amplifiers are necessary in the example.

In the production of controlled effects one or more effect threads of variable speed are supplied to a basic thread which as a rule runs at a constant speed. It is possible to go beyond this and have the effect threads, exactly as with an uncontrolled effect, supplied to the basic thread with a predetermined relative speed. The formation of an effect will only arise through alteration of the speed of one or several effect threads. In this the speed is in general higher so that more threads are supplied. This oversupply produces in the combined threads a thick portion and also causes a color change if worked with different colors of yarn. The length of the thickened portions and their separation from each other are determined by the program described above.

With the control in accordance with the invention the program can be adjusted in a truly clear and thereby simple manner. With the proportion 1:1, the basic thread supply can, that is to say, be set equal to 1 mm feed for one timing pulse. By means of coding plugs the position at which an alteration in the effect threads should occur can be programmed directly in mm. in the switch instruction selector 9.

For example if the threads are to run for a 50 mm length in the basic formation and thereafter a 30 mm long effect is to be formed, a coding plug 50 and a coding plug 80 are inserted in the switch instruction selector 9 and the desired feed device is chosen at the switch instruction coordinator 11. The whole program can be set out in the switch instruction selector 9 up to instruction 999. It can however also repeat itself already at instruction 90. The switch instruction "program ends" is likewise plugged in. The counter re-sets itself to 0 at "program ends" and counts out again anew.

If a short program is to repeat for example 10 times, and then change over to another program, which likewise, for example, repeats five times, the first program (I) does not need to be programmed in 10 times, but only once, and the second program likewise need only be set up once, but in an additional control program unit 14, which is of the same construction as the control program unit 8 and is parallel to the latter at the output.

The repetition of the program I 10 times is plugged into the switch instruction selector 17 of the repeat program counter 7 with coding plugs. With each reset pulse of the counter 10 in the program I, the counter 15 of the repeat program is advanced by one instruction.

Upon reaching the 10th pulse the switch 16 is operated and thus switched over to program II. Now the reset pulses of the program II are counted, in the example five pulses. At the 15th instruction the counter network switches back again to program I. However now the program I need not run again 10 times but for example 25 times can be chosen. The switching over to program II would then result at instruction 40 of the counters. With this arrangement it is possible to produce a very large module by selective repetition of two different basic programs, without programming at large expense. In the present invention a counter 15 with 99 instructions is provided in the repeat program unit 7, but an enlarged counter can be introduced so that the possibilities of variation are multiplied. After the desired programmed switch instructions the switch instruction "program ends" is plugged in. When this instruction is reached, resetting of the counter to 0 results and the pulse counting in accordance with the program begins anew.

For the production of complicated effects, for which the programming units and the programming process would increase to uneconomic degrees, a speciality program unit is provided in place of the repeat program unit. If, for example, a progressive effect is to be produced, in which the colours blue and white interchange themselves in a gradual transition over a module length, a speciality program unit is inserted which has two counters working in opposition, whose count limits should be, for example, 15. The effect formation is then as follows: program 1 with the color blue runs 15 times while program 2 with the color white runs once. Now the counters switch in opposition so that program 1 runs 14 times and program 2 twice and so on up to 15 times program 2 with white and once program 1 with blue. After the count back to 15 times blue and once white one module length is ended. Variation of the module length is effected as already described. The progressive color change described in the example is also of course possible with each other effect such as caterpillar, knots, and so on.

The run out of the above described programs repeats itself exactly periodically, which with yarn which is further processed can result in a patterning which is often not desired in the appearance of the material. For this reason it is necessary so to interrupt the program that a repetition is merely left to chance.

The invention provides for this an interruptor 18 which consists of a chance or random pulse generator 19, an interruption pulse counter 20, a comparison counter 21, a selector switch 22 for the interruption point and a coder 23.

With a single interruptor 18 it is possible for example to alter the effect length and thus the thread length during a knotting or a caterpillar. Exactly so however the stretch between the effects can also be interrupted, so that the separation between effects is altered. The effect and the separation can however also be interrupted with the same interruption magnitude. If however effect and separation are to be interrupted with different interruption magnitudes, a second interruptor 25 is necessary.

The maximum interruption magnitude can be programmed in directly in mm. by means of the coding plug 23. The selector switch 24 determines whether the interruption should operate on the effect, or on the separation or on both. The chance generator 18 supplies to the counter network 20 continual pulses at purely random intervals, which are counted in the counter network 20 until the number of a programmed maximum interruption length is reached. After reaching the programmed number the counter network resets to 0 and begins to run through again.

If now the effect is to be interrupted, each start pulse delivered by the control program (e.g., counter 8) for initiating an effect operates a hold of the counter network 20 and an interruption of the counting pulse transmission by the interruptor 24. At the same time the comparison counting network 21 begins to count out timing pulses 3 and continues until an equal count state of the interruption pulse counting network 20 and the comparison counting network 21 is achieved. Both counting networks reset to 0, the interruptor 24 opens again, so that the counting pulse 6 effects the continuation of the program. Through the completely irregular and purely random supply of pulses from the chance generator 19, the count state of the counting network 20 at the instant of the functional commencement of the interruption will never repeat. Each effect stretch will therefore extend over a different number of mm., which is equal to the number of timing pulses acting on the interruptor.

The alteration of the program is very simple with this system of the coding plug. The coding plug is merely exchanged to correspond to the new mm. value. The whole program can be easily and quickly replaced by another program, if the coding plugs are pushed through a perforated board of synthetic plastics material. The prepared program then consists of a board, in which the coding plugs have been inserted in position.

Another coding arrangement would be a diode matrix, known per se.

The whole program lies under a supervision function which is not shown in the FIGURE. This supervision prevents the production of undesired effects as a result of a non-logical programming or disturbance in the electronics. For this purpose according to the program input being followed there is read into a store which clutches and brakes must be in operation at a particular point in time. During the operation it is asked at short time intervals whether these operations are being carried out. If there is no agreement, the machine is automatically brought to a stop.

I claim:

1. In a twisting and spinning machine, a switching arrangement for producing effect yarns having at least two thread feeding devices, the speed of at least one of said thread feeding devices being selectively controllable, the improvement comprising an electrical pulse generating timing device synchronous with said machine and at least one manually settable and cyclical electrical pulse counter for producing an electrical pulse pattern at the output thereof in response to a preselected number of pulses supplied thereto, a pulse divider circuit connected between said timing device and said electrical pulse counter and being controlled by said timing device, said pulse generating timing device having a characteristic wherein the electrical pulse period of each pulse delivered to said pulse divider circuit corresponds to a unit of length of a thread supply, said pulse divider circuit having the characteristic of altering the effective time interval of pulses delivered to said pulse counter so that the length thereof is different from the time interval of pulses delivered to said pulse divider circuit from said timing device, and speed control means responsive to the output of said pulse counter for selectively altering the speed of said one thread feeding device.

2. A switching arrangement according to claim 1, wherein 1 mm of thread supply is used as said unit of length.

3. A switching device according to claim 1, wherein said electrical pulse counter is programmable at its input side and its output side.

4. A switching arrangement according to claim 1, wherein said pulse divider circuit includes adjustment means for adjusting the time interval between output pulses therefrom.

5. A switching arrangement according to claim 1, wherein said electrical pulse counter includes means for effecting a repeat in said electrical output pulse pattern.

6. A switching arrangement according to claim 1, wherein two manually settable electrical pulse counters are connected in parallel and between said timing device and each of said pulse counters a programmable repetition control unit is inserted whose output is switchable between the inputs of said several pulse counters.

7. A switching arrangement according to claim 6, wherein each of said pulse counters includes means for producing a return signal and wherein said repetition control unit is connected in circuit with each of said return signal producing means to effect said switching to the input of the other of said pulse counters in response to a return signal.

8. A switching arrangement according to claim 6, wherein said repetition control unit has the characteristic of producing a cyclical output pulse pattern.

9. A switching arrangement according to claim 1, wherein the pulse counter has plural output terminals each connected to an output amplifier connected in circuit with said speed control means.

10. A switching arrangement according to claim 1, including interruptor means connected in circuit with said timing device and the output of said pulse counter and has a random pulse generator and at least one further counter therein.

11. A switching arrangement according to claim 10, wherein said interruptor is programmable.

12. A switching arrangement according to claim 10, wherein said interruptor means includes a second counter responsive to timing pulses from said timing device and wherein said further counter is responsive to pulses from said random pulse generator, the count of said second counter being continually compared to the count of said further counter.

13. A switching arrangement according to claim 12, wherein said interruptor means includes means for suspending the flow of timing pulses to said pulse divider circuit for a time dependent upon the content of said further counter.

14. A switching arrangement according to claim 10, wherein said interruptor is programmable for effect length and/or separation between effects.

15. A switching arrangement according to claim 10, wherein for different interruption magnitudes for effect length and effect separation a second interruptor means is provided and connected in parallel with said first-mentioned interruptor means.

16. A switching arrangement according to claim 1, wherein said pulse counter includes a matrixlike frame having plural recesses therein and wherein coding plugs are received in said recesses to effect a manual setting of said pulse counter.

17. A programmable control unit for an effect spinning or twisting machine having at least two thread feeding devices, the speed of at least one being selectively controllable, comprising a timing device drivable by the machine to produce timing pulses in synchronization with the feed of the basic thread, a manually settable electrical pulse counter, a programmable pulse divider circuit connected between said timing device and said electrical pulse counter, said pulse divider circuit having the characteristic of altering the effective time interval of pulses delivered to said pulse counter so that the length thereof is different from the time interval of pulses delivered to said pulse divider circuit from said timing device, said pulse counter being drivable by the timing pulses altered by said pulse divider circuit to effect a control of the length of thread supplied to said machine between preselected programmed intervals, said pulse counter having an input selector settable to determine the count(s) at which a change in the output of said pulse counter is to take place and an output selector settable to determine the thread feed device to be changed and the nature of the change at said output of said pulse counter to thereby effect said control of the length of thread supplied to said machine.

* * * * *